US005992274A

United States Patent [19]

Lammers

[11] Patent Number: 5,992,274

[45] Date of Patent: Nov. 30, 1999

[54] INSTALLATION TOOL FOR PRE-ASSEMBLED SCREW AND PLATE ASSEMBLIES

[75] Inventor: Robert Lammers, Wyomissing, Pa.

[73] Assignee: Construction Fasteners, Inc., Wyomissing, Pa.

[21] Appl. No.: 08/977,911

[22] Filed: Nov. 25, 1997

Related U.S. Application Data

[60] Provisional application No. 60/031,944, Nov. 27, 1996.

[51] Int. Cl.[6] ..... B25B 23/08

[52] U.S. Cl. ..... 81/451

[58] Field of Search ..... 81/451, 125

[56] References Cited

U.S. PATENT DOCUMENTS

| | | | |
|---|---|---|---|
| 909,723 | 1/1909 | Wiesedeppe | 81/451 |
| 1,495,906 | 5/1924 | Kendall | 81/451 |
| 4,945,789 | 8/1990 | Martinengo | 81/55 |
| 5,263,390 | 11/1993 | Levy et al. | 81/125 |
| 5,379,504 | 1/1995 | Sovitch et al. | 29/270 |

*Primary Examiner*—David A. Scherbel
*Assistant Examiner*—Philip J. Hoffmann
*Attorney, Agent, or Firm*—Caesar, Rivise, Bernstein, Cohen & Pokotilow, Ltd.

[57] ABSTRACT

An installation tool for pre-assembled screw and plate assembles. The tool has magnetic areas in a plastic nose piece that enables the installer to use the tool to pick up a screw and plate assembly by the head and install the fastener. The tool can be used with pre-assembled screw and plate assembles that are laying on an insulation board with head up or down, as well as pre-assembled screw and plate assemblies that have been impaled or stuck into the insulation board.

14 Claims, 4 Drawing Sheets

2
28
30
14
10
12
32
34
16
22
26
58
18
20
60
2

INSTALLATION TOOL FOR PRE-ASSEMBLED SCREW AND PLATE ASSEMBLIES

CROSS-REFERENCE TO RELATED APPLICATIONS

This application claims the benefit of the filing date of provisional application Ser. No. 60/031,944 filed on Nov. 27, 1996, entitled Installation Tool for Pre-Assembled Screw and Plate Assemblies, by Robert Lammers, the entire disclosure of which is incorporated by reference herein.

BACKGROUND OF THE INVENTION

The present invention relates to an installation tool for pre-assembled screw and plate assemblies. The tool has magnetic areas in a plastic nose piece that enables the installer to use the tool to pick up a screw and plate assembly by the head and install the fastener. The tool can be used with pre-assembled screw and plate assemblies that are laying on an insulation board with head up or down, as well as pre-assembled screw and plate assemblies that have been impaled or stuck into the insulation board. The tool can also be used to pick up a screw and install it through a plate without having the screw and plate preassembled.

One prior art device for fastening a screw and metallic washer is disclosed in U.S. Pat. No. 5,517,883 (Goldi et al.). The fastening element of that device includes a screw and large-surface washer to attach sheeting onto a solid substructure. The screw has a drill tip, a shaft with a thread that extends over at least part of its length and a screw head. The washer has an aperture to insert the screw shaft having a diameter that approximately corresponds to the sum of the core diameter and the height of one thread. The washer is preassembled at a distance from the screw head to restrict axial movement of the washer in the threaded area of the screw shaft until there is rotation of the screw in the washer. The Goldi device also includes a screw-in device which has permanent magnets inserted into two openings that are directly parallel to the axis of the receptacle pipe and radially oppose each other with reference to the receptacle pipe. It does not appear that the Goldi device is capable of retrieving and holding screw and washer assemblies for installation as in the present invention.

BRIEF SUMMARY OF THE INVENTION

The present invention relates to an installation tool for pre-assembled screw and plate assemblies. The tool has magnetic areas in a plastic nose piece that enables the installer to use the tool to pick up a screw and plate assembly by the head and install the fastener. The tool can be used with pre-assembled screw and plate assemblies that are laying on an insulation board with head up or down, as well as pre-assembled screw and plate assemblies that have been impaled or stuck into the insulation board or can pick up a screw only (not preassembled with a plate).

DETAILED DESCRIPTION OF THE INVENTION

Figure 1:
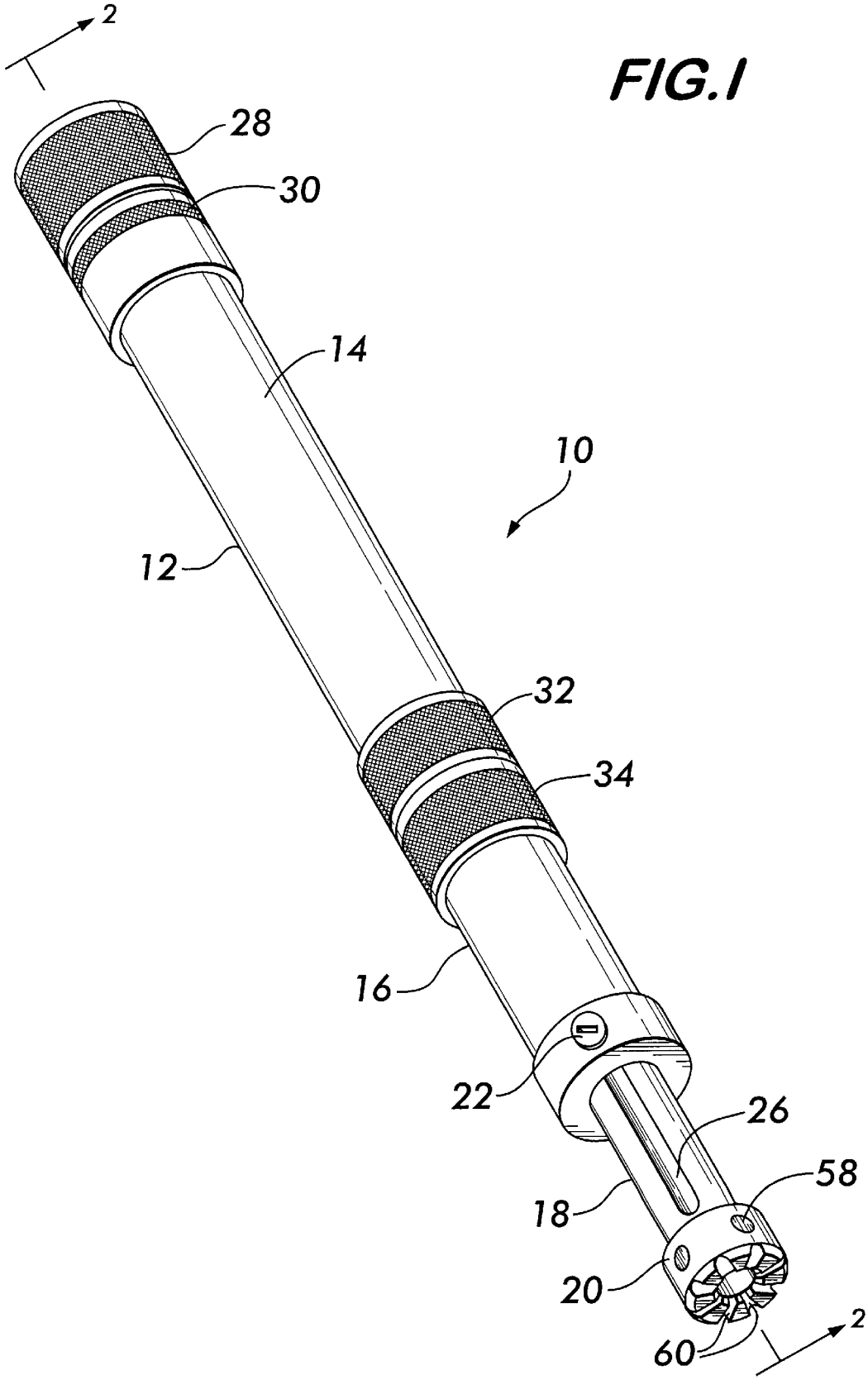
FIG. 1 is a perspective view of the installation tool of the present invention.

Referring now to various figures of the drawings where like reference numerals refer to like parts, there is shown at in FIG. 1, a tool 10 constructed in accordance with this invention. The tool 10 comprises a hollow two-piece extension body 12 comprising an upper body portion 14 and a lower body portion 16. A nose piece 18 passes through the lower body 16 and protrudes at the proximal end thereof and includes a nose piece end 20. The nose piece 18 is releasably retained within the lower body 16 at the desired position by set screw 22 located in collar 24 located at the end of the lower body portion 16. The set screw 22 interferingly engages a channel 26 in the nose piece 18 so that the nose piece 18 can travel into the lower body 16 and return within the limits provided by the length of channel 26.

The upper body portion 14, includes an optional tool adapter collar 28 to provide a means of connecting tool 10 to a rotating power source such as an electric screw driver (not shown). Located adjacent the optional tool adapter 28, is a locking collar 30 to aid in retaining a drive rod (discussed herein) within the two-piece extension body 12 to enable the driving of a screw as described below. Both of the collars 28 and 30 may have their exterior surfaces knurled to aid in securing and removing the collars as desired.

Figure 2:
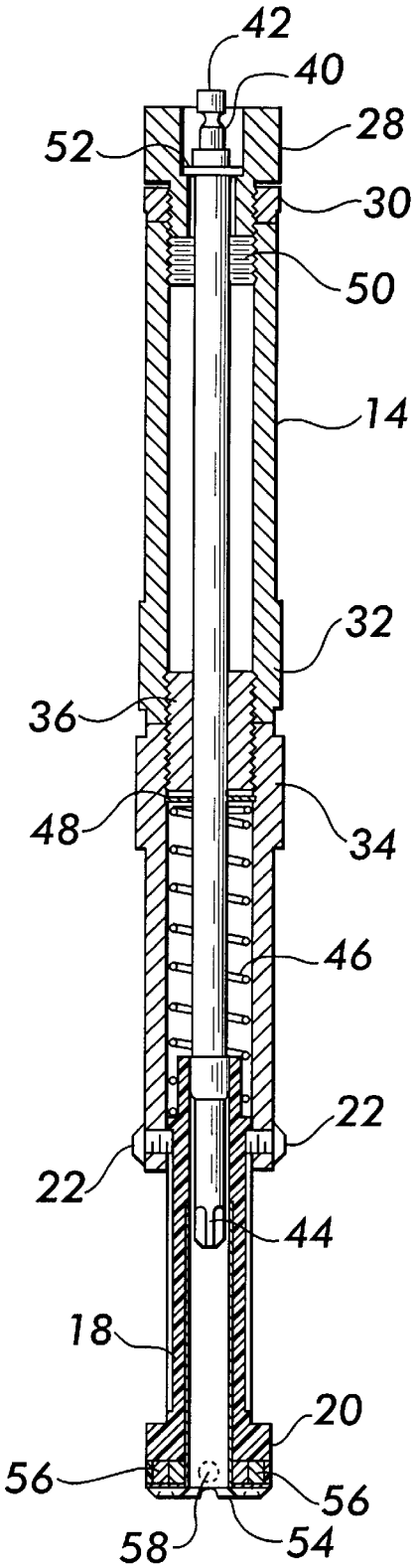
FIG. 2 is a cross-section of the nose piece of the installation tool of the present invention taken along line 2—2 of FIG. 1.

As further shown in FIG. 1, the upper body portion 14 and lower body portion 16 are mated by hubs 32 and 34 which may be knurled to aid in securing and separating the upper and lower body portions 14 and 16, respectively. As shown in FIG. 2, the upper body portion 14 and lower body portion 16 are joined by a connecting sleeve 36 which may be threaded to mate with the internal portions of upper body portion 14 and lower body portion 16 and which aids in holding the outer limit of the compression spring as described in detail below.

Located within the hollow extension body 12 is a drive rod 40. The drive rod 40 includes an outer portion containing a drive element 42 adapted to be received within a conventional drive screw gun (not shown) which rotates the drive rod 40 within the tool body 12. At the opposite end of the drive rod 40 is located a conventional screw driver 44, with a Phillips screw driver being shown in FIG. 2. As the drive rod 40 is rotated the screw driver 44 rotates to install a screw in accordance with the present invention as described in further detail below.

As also shown in FIG. 2, the device 10, includes a compression spring 46, located in the lower body portion 16 and retained at its upper end by snap ring 48. Located between the snap ring 48 and the spring 46 is a shim (not shown) which acts as a seat for the spring 46 and aids in retaining the spring 46 so that the spring does not slide up and around the snap ring 48. The purpose of the spring 46 is to position nose piece 18 in its forwardmost position relative to lower body 16.

As shown in FIG. 2, the locking collar 30 is threaded to matingly engage the exterior surface of adaptor collar 28 which is attached to body 14 with threads 50. To further aid in retaining the drive rod 40 in the desired orientation, a snap ring 52 is located at the upper end of the driver rod 40.

Figure 3:
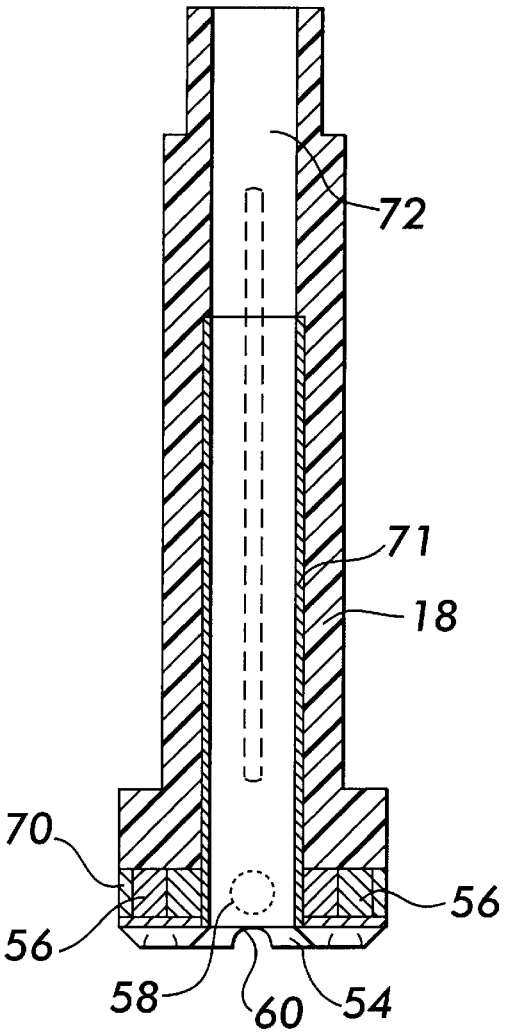
FIG. 3 is a partial cross-section of the nose piece of the tool of the present invention.
Figure 4A:
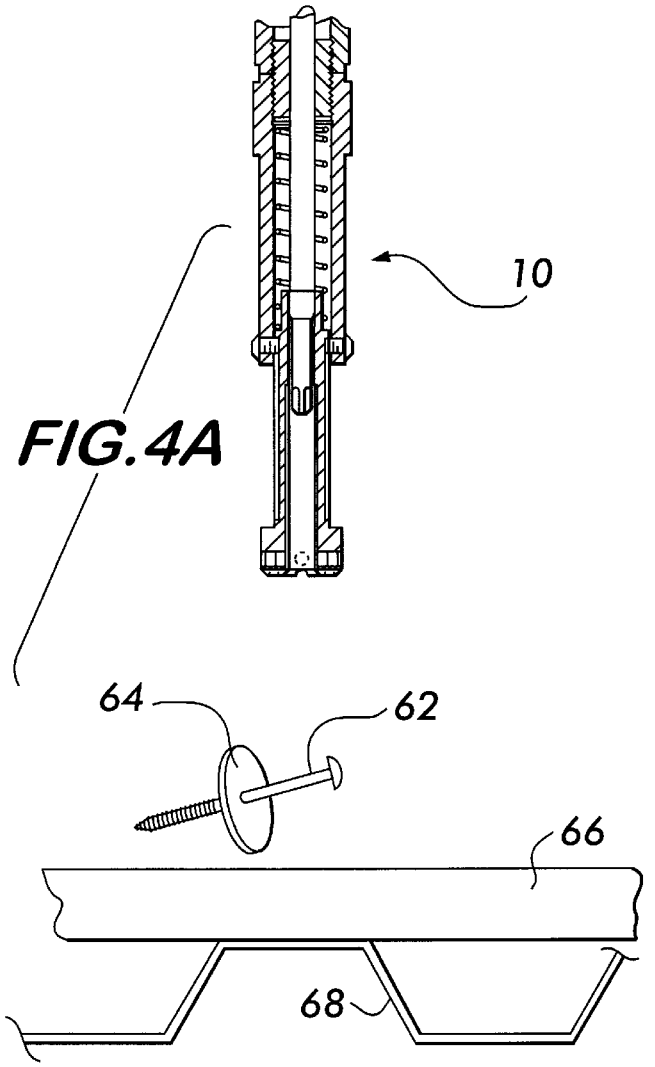
FIG. 4A is a partial side view cross-sectional view of the installation tool of the present invention shown above a surface in the process of the tool retrieving a screw and plate assembly.
Figure 4B:
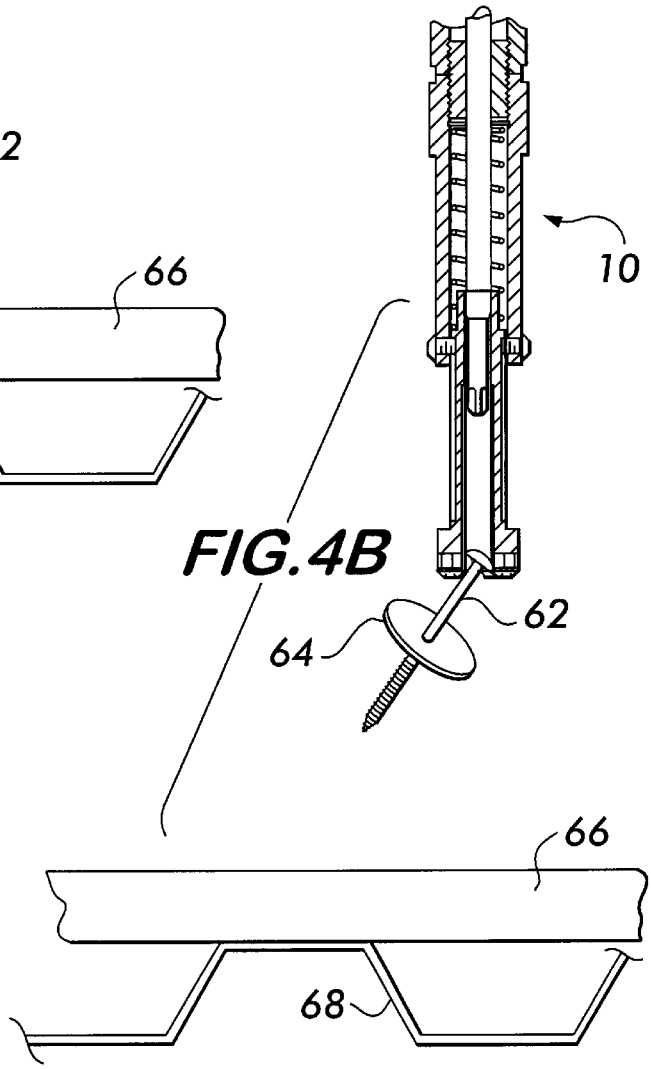
FIG. 4B is a partial side view cross-sectional view of the installation tool of the present invention shown above a surface in the process of having retrieved a screw and plate assembly.
Figure 4C:
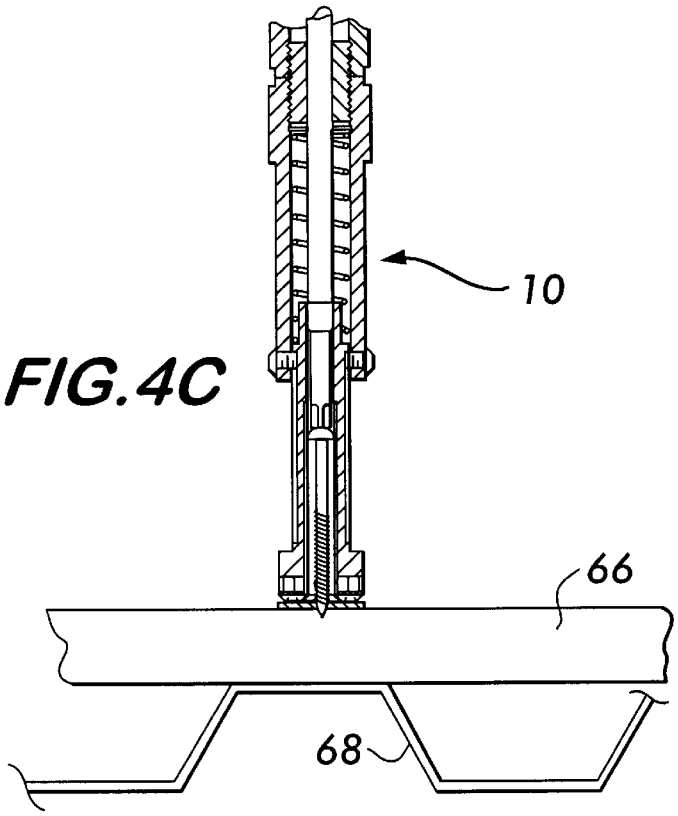
FIG. 4C is a partial side view cross-sectional view of the installation tool of the present invention with the screw and plate assembly being held by the tool as it is about to be installed into the surface.
Figure 4D:
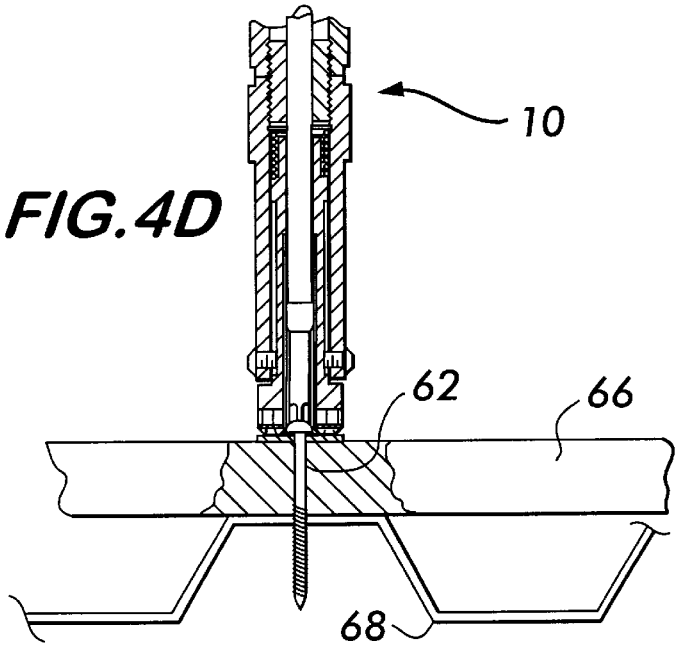
FIG. 4D is a partial side view cross-sectional view of the installation tool of the present invention with the screw and plate assembly after it is installed into the surface.

As also shown in FIGS. 2 and 3, the nose piece 18 includes opening 54 to receive the head of a fastener as described in further detail below. While the nose piece 18 may be comprised of any suitable material, it is preferably made of a plastic material such as nylon. A metallic liner 71 is positioned inside nose piece 18 to prevent wearing of the throughbore during driving of the screw. Adjacent the opening 54 of the nose piece 18 are located a plurality of magnets 56 which aid in holding a fastener to be fastened utilizing the device 10 of the present invention. Preferably these magnets are comprised of rare earth materials such as an alloy of neodymium and boron. In the embodiment shown, four such magnets 56 are utilized and are placed 90° apart, although any number and type of magnets may be used depending upon the circumstances of use. The magnets 56 are pressed into the desired position through openings 58 and are frictionally retained therein. A plastic plug 70 may be used to cover the exposed ends of the magnets 56. The end of the nose piece 20, also includes a plurality of channels 60 in which the elongated portion of a fastener may rest while being temporarily retained by the tool 10, prior to installation of the fastener to a surface.

The tool 10 may be used to install a fastener as shown in FIG. 4. In FIG. 4A, the fastener 62 includes plate 64, the combination of which may be laid on an upper surface 66 to be joined to a lower surface 68. As shown in FIG. 4B, the magnetic or inner end of the nose piece 20, is placed adjacent the fastener 62 so that the magnets 56 hold the fastener 62 so that the head thereof is retained within the opening of the nose piece 20. The fastener 62 is then received within the throughbore 72 of the nose piece 18 so that the tip of the fastener 62 is adjacent the upper surface 66 to be joined to lower surface 68 as shown in FIG. 4C by the installer applying downward pressure to the tool. The downward pressure allows the fastener to advance into the hollow throughbore 72 of the nose piece 18. Continued downward pressure causes the spring-loaded nose piece 18 to telescope into the tool body and allows the screw drive head 44 to engage the fastener 62. As shown in FIG. 4D, the fastener 62 is then screwed into the upper surface 66 to mate lower surface 68, by rotating the drive stem 40 by a conventional electric screw driver (not shown). Installation of the fastener 62 is complete when the tool 10 is fully compressed and the fastener/plate assembly is snug against the upper surface 66.

Without further elaboration the foregoing will so fully illustrate my invention that others may, by applying current or future knowledge, adapt the same for use under various conditions of service.

I claim:

1. A device for installing a screw having an internal or external drive head and optionally an associated plate, said device comprising:

a. A hollow extension body having an upper and lower end;

b. A nose piece including magnets for picking up a screw by its head and optionally an associated plate; the nose piece extending from the hollow extension body;

c. A driver having an upper end to which a drive element is connected, the driver also having a lower end, and said nose piece being located at said lower end to engage the screw head to enable the device to drive the screw into a surface, a portion of the driver being located within the hollow extension body, said nose piece acting to pick up a screw by its head and an optionally associated plate assembly and install the screw and said optionally associated plate assembly, said magnets being located in the nose piece for releasably attracting said screw and optionally associated plate.

2. The device of claim 1 wherein said magnets are located such that the axis of at least one of said magnets is perpendicular to the axis of the nose piece and radially displaced from said axis.

3. The device of claim 1 wherein the extension body comprises an upper body portion and lower body portion wherein the upper and lower body portions are releasably secured to one another.

4. The device of claim 1 additionally comprising a set screw to releasably secure the nose piece to a desired position with respect to the hollow extension body.

5. The device of claim 1 additionally comprising a tool adapter collar located adjacent the upper end of the hollow extension body.

6. The device of claim 1 wherein the gripper is a spring loaded nose piece.

7. The device of claim 1 wherein the pick up means is a spring loaded nose piece.

8. The device of claim 1 wherein the driver is a drive rod.

9. A device for installing a screw having an internal or external drive head and optionally an associated plate, said device comprising:

a. A hollow extension body having an upper and lower end;

b. Pick up means for picking up a screw by its head and optionally an associated plate, the pick up means extending to the hollow extension body; said pick up means acting to pick up a screw by its head and an optionally associated plate assembly and install the screw and optionally associated plate assembly comprises at least one magnet affixed to a nose piece contained within the hollow extension body to attract a screw and optionally associated plate to be installed, said magnet being locate such that its axis is perpendicular to the axis of the nose piece and radially displaced from said axis; and c. Driving means having an upper end to which a drive element is connected, the driving means also having a lower end including a means to engage the screw head to enable the device to drive the screw into a surface, a portion of the driving means being located within the hollow extension body.

10. The device of claim 9 wherein the extension body comprises an upper body portion and a lower body portion wherein the upper and lower body portions are releasably secured to one another.

11. The device of claim 9 additionally comprising a set screw to releasably secure the nose piece to a desired position with respect to the hollow extension body.

12. The device of claim 9 additionally comprising a tool adapter collar located adjacent the upper end of the hollow extension body.

13. The device of claim 1 wherein the driving means is a drive rod.

14. The device of claim 1 wherein the at least one magnet is releasably contained within the hollow extension body.

* * * * *